US008678490B2

(12) United States Patent
Chen

(10) Patent No.: US 8,678,490 B2
(45) Date of Patent: Mar. 25, 2014

(54) FOLDING CHAIR

(76) Inventor: Zhaosheng Chen, El Monte, CA (US)

( * ) Notice: Subject to any disclaimer, the term of this patent is extended or adjusted under 35 U.S.C. 154(b) by 268 days.

(21) Appl. No.: 13/286,110

(22) Filed: Oct. 31, 2011

(65) Prior Publication Data

US 2013/0106145 A1 May 2, 2013

(51) Int. Cl.
*A47C 4/42* (2006.01)

(52) U.S. Cl.
USPC ..... 297/36; 297/45

(58) Field of Classification Search
USPC ..... 297/16.1, 36, 44, 45, 411.34
See application file for complete search history.

(56) References Cited

U.S. PATENT DOCUMENTS 1,703,879 A * 3/1929 Goldwyn ..... 297/36
3,730,584 A * 5/1973 Uchida ..... 297/45
4,566,731 A * 1/1986 Marchesini ..... 297/45
6,540,290 B2 * 4/2003 Liu ..... 297/45
7,918,495 B2 * 4/2011 Chen ..... 297/42
8,292,361 B2 * 10/2012 Chen ..... 297/42
2010/0171342 A1 * 7/2010 Chen ..... 297/45

* cited by examiner

*Primary Examiner* — Peter Brown
(74) *Attorney, Agent, or Firm* — Clement Cheng

(57) ABSTRACT

A folding chair has a left leg and a right leg. A front frame connects the left leg to the right leg, wherein the front frame folds between an open position and a closed position and from a closed position to an open position. A rear frame connects the left leg to the right leg, and the rear frame is foldable. The front frame has a front frame right upper support pivotally connecting to a front frame left upper support, and the front frame right upper support is pivotally connected to the right leg at a front right upper connection. The front frame left upper support is pivotally connected to the left leg at a front left upper connection. The front frame also has a front frame right lower support pivotally connecting to a front frame left lower support.

6 Claims, 4 Drawing Sheets

FOLDING CHAIR

FIELD OF THE INVENTION

The present invention is in the field of folding chairs.

DISCUSSION OF RELATED ART

A variety of different folding chairs have been designed for portable seating.

SUMMARY OF THE INVENTION

A folding chair has a left leg and a right leg. A front frame connects the left leg to the right leg. The front frame folds between an open position and a closed position and from a closed position to an open position. A rear frame connects the left leg to the right leg, and the rear frame is foldable. The front frame has a front frame right upper support pivotally connecting to a front frame left upper support, and the front frame right upper support is pivotally connected to the right leg at a front right upper connection. The front frame left upper support is pivotally connected to the left leg at a front left upper connection.

The front frame also has a front frame right lower support pivotally connecting to a front frame left lower support. The front frame right lower support is pivotally connected to the right leg at a front right lower connection. The front frame left lower support is pivotally connected to the left leg at a front left lower connection. The front frame right lower support is pivotally connecting to the front frame right upper support at a front frame right pivoting connection. The front frame left lower support is pivotally connecting to the front frame left upper support at a front frame left pivoting connection.

The front frame right lower support is pivotally mounted to a front frame right lower connection, and the front frame right lower connection is sliding mounted to a right leg vertical support. The front frame left lower support is pivotally mounted to a front frame left lower connection, and the front frame left lower connection is sliding mounted to a left leg vertical support.

The rear frame also has a rear frame right upper support pivotally connecting to a rear frame left upper support. The rear frame right upper support is pivotally connected to the right leg at a rear right upper connection. The rear frame left upper support is pivotally connected to the rear left leg at a rear left upper connection. The rear frame has a rear frame right lower support pivotally connecting to a rear frame left lower support, and the rear frame right lower support is pivotally connected to the right leg at a rear right lower connection. The rear frame left lower support is pivotally connected to the left leg at a rear left lower connection.

The rear frame right lower support is pivotally connecting to the rear frame right upper support at a rear frame right pivoting connection. The rear frame left lower support is pivotally connecting to the rear frame left upper support at a rear frame left pivoting connection. The front frame right lower support is pivotally mounted to a front frame right lower connection. The front frame right lower connection is sliding mounted to a right leg vertical support. The front frame left lower support is pivotally mounted to a front frame left lower connection. The front frame left lower connection is sliding mounted to a left leg vertical support.

A armrest support assembly is formed as armrest support vertical members, and the armrest support vertical members are connected to the front frame and the rear frame. A seatback has a left armrest and a right armrest. The left armrest is pivotally mounted to a top end of the left leg and the right armrest is pivotally mounted to a top end of the right leg. The left armrest and the right armrest fold 180° from an upward position to a downward position.

The following call out list of elements references the call-out numbers of the drawings.

20 Left Leg
21 Left Leg Lower Horizontal Support
22 Left Leg Front Vertical Support
23 Left Leg Rear Vertical Support
24 Left Leg Upper Horizontal Support
25 Left Leg Front Foot
26 Left Leg Rear Foot
27 Left Leg Front Connector
28 Left Leg Rear Connector
30 Right Leg
31 Right Leg Lower Horizontal Support
32 Right Leg Front Vertical Support
33 Right Leg Rear Vertical Support
34 Right Leg Upper Horizontal Support
35 Right Leg Front Foot
36 Right Leg Rear Foot
37 Right Leg Front Connector
38 Right Leg Rear Connector
40 Front Frame
41 Front Frame Right Lower Support
42 Front Frame Left Lower Support
43 Front Frame Right Upper Support
44 Front Frame Left Upper Support
143 Front Frame Right Pivoting Connection
144 Front Frame Left Pivoting Connection
45 Front Frame Right Upper Connection
46 Front Frame Left Upper Connection
47 Front Frame Lower Right Connection
48 Front Frame Lower Left Connection
49 Front Frame Upper Hinge
149 Front Frame Lower Hinge
50 Rear Frame
51 Rear Frame Right Lower Support
52 Rear Frame Left Lower Support
53 Rear Frame Right Upper Support
54 Rear Frame Left Upper Support
153 Rear Frame Right Pivoting Connection
154 Rear Frame Left Pivoting Connection
55 Rear Frame Right Upper Connection
56 Rear Frame Left Upper Connection
57 Rear Frame Lower Right Connection
58 Rear Frame Lower Left Connection
59 Rear Frame Upper Hinge
159 Rear Frame Lower Hinge
60 Seat Back
61 Rear Seat Back Support
62 Front Seat Back Support
63 Armrest
64 Seat Back Front Vertical Member
70 Armrest Support Assembly
71 Armrest Support Right Vertical Member
72 Right Grip Pivot

74 Left Grip Pivot
75 Armrest Support Left Vertical Member
76 Armrest Support Vertical Member Pivoting Connection

DETAILED DESCRIPTION OF THE PREFERRED EMBODIMENT

Figure 1:
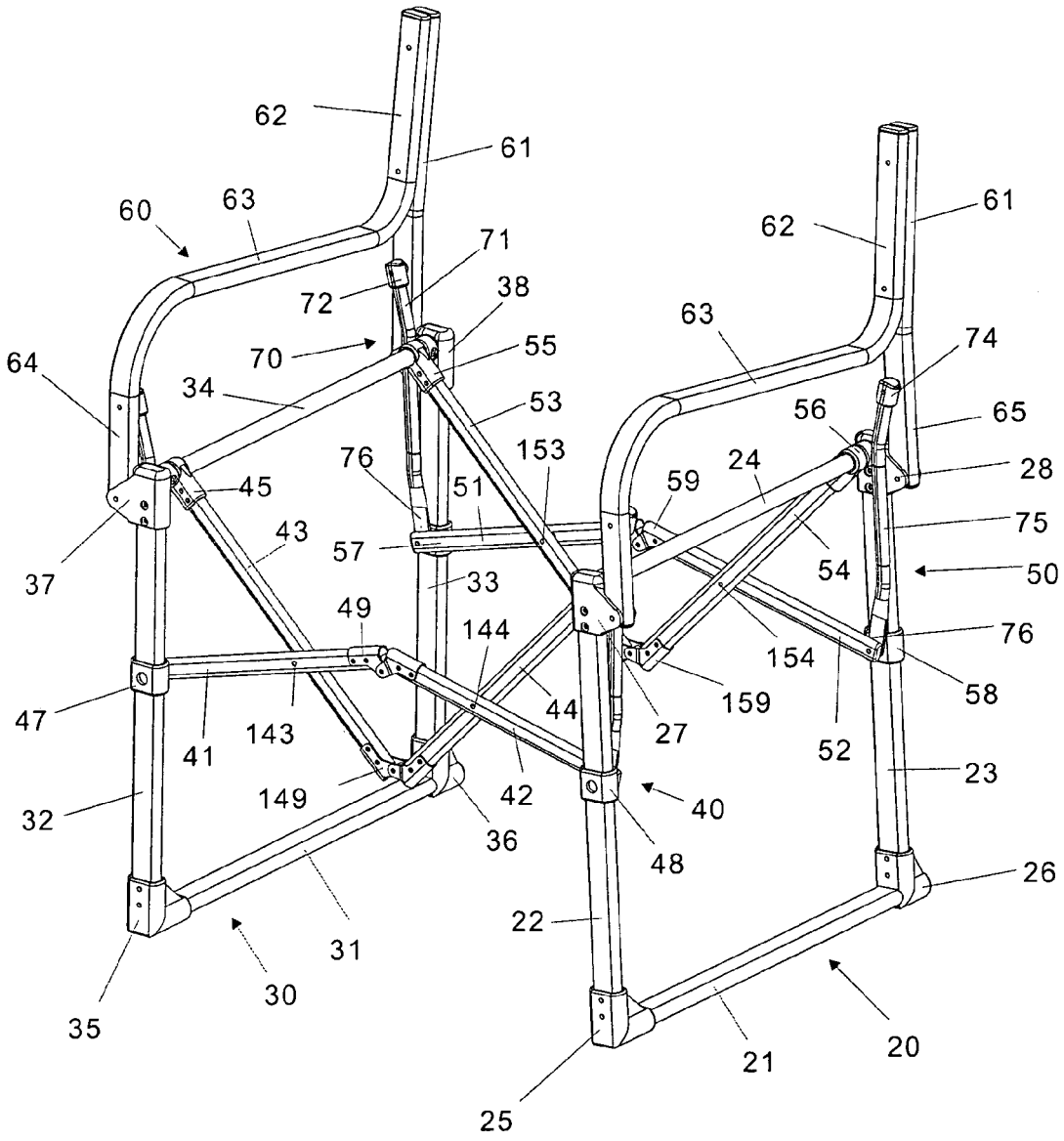
FIG. 1 is a folding chair in open position.
Figure 2:
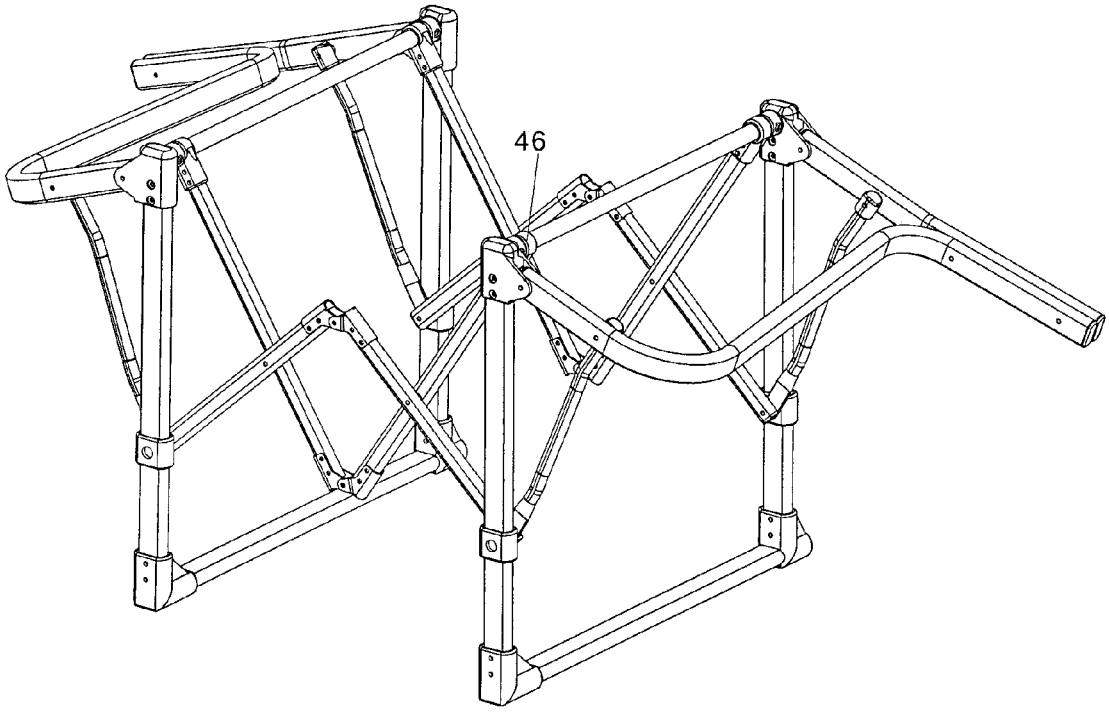
FIG. 2 is a folding chair in intermediate position.
Figure 3:
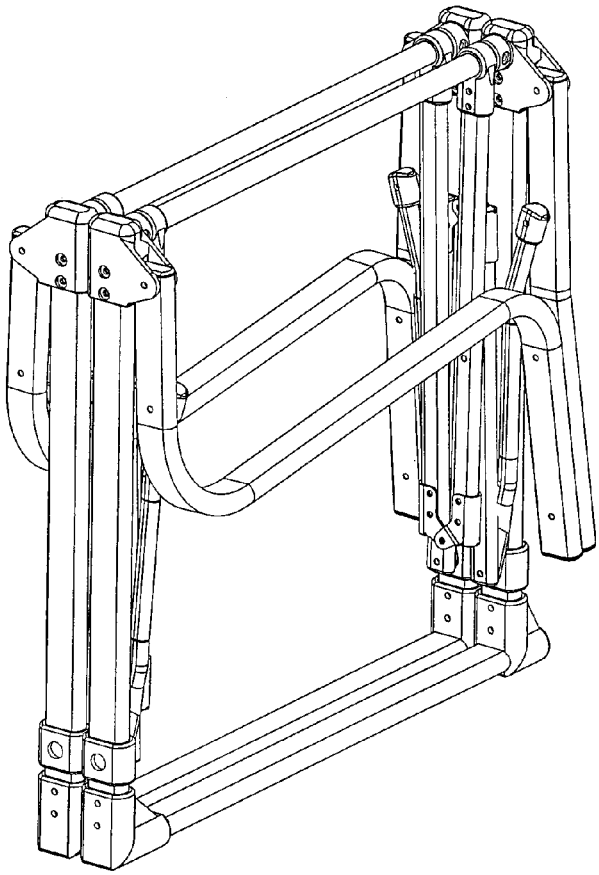
FIG. 3 is a folding chair in a closed position, also called a folded position.

The present invention is shown in FIGS. 1-3 and provides for a left leg 20, connected to a right leg 30 by a front frame 40 and a rear frame 50. An optional seat back 60 supports a user back and also optionally provides armrests. A armrest support 70 is formed as four pivoting posts having grip pivots to pivotally connect them to the armrests and seatback.

The left leg 20 is preferably formed as a rectangular frame of hollow extruded aluminum elongated support members having ends that connect into plastic injection molded connectors. The support member is may have flat portions or rounded portions that can receive a set screw or a bolt through a side wall of a support member. The left leg includes a left leg lower horizontal support 21 that is parallel to the ground and may provide additional support on soft ground. The left leg lower horizontal support 21 has a gap away from the ground such that it does not touch the ground if the chairs placed on a flat surface. The left leg lower horizontal support is connected to a left leg front foot 25 and a left leg rear foot 26. The left leg front foot 25 and the left leg rear foot 26 may have sockets for receiving the ends of the left leg lower horizontal support. The left leg front vertical support 22 connects to the left leg front foot 25 and the left leg rear vertical sport 23 connects to the left leg rear foot 26. The left leg front connector 27 connects to the left leg front vertical support 22 and the left leg rear connector 28 connects to the left rear vertical support 23. A left leg upper horizontal support 24 is preferably made of a round cross-section formed as a tube and having ends fitting to sockets of the left leg front connector 27 and the left leg rear connector 28. In total, the left leg 20 has preferably four support parts and four connector parts.

The structure of the right leg can be a mirror image of the structure of the left leg. The right leg 30 is preferably formed as a rectangular frame of hollow extruded aluminum elongated support members having ends that connect into plastic injection molded connectors. The support member is may have flat portions or rounded portions that can receive a set screw or a bolt through a side wall of a support member. The right leg includes a right leg lower horizontal support 31 that is parallel to the ground and may provide additional support on soft ground. The right leg lower horizontal support 31 has a gap away from the ground such that it does not touch the ground if the chairs placed on a flat surface. The right leg lower horizontal support is connected to a right leg front foot 35 and a right leg rear foot 36. The right leg front foot 35 and the right leg rear foot 36 may have sockets for receiving the ends of the right leg lower horizontal support. The right leg front vertical support 32 connects to the right leg front foot 35 and the right leg rear vertical sport 33 connects to the right leg rear foot 36. The right leg front connector 37 connects to the right leg front vertical support 22 and the right leg rear connector 38 connects to the right rear vertical support 33. A right leg upper horizontal support 34 is preferably made of a round cross-section formed as a tube and having ends fitting to sockets of the right leg front connector 37 and the right leg rear connector 38. In total, the right leg 30 has preferably four support parts and four connector parts.

The front frame 40 makes connection between the left leg and the right leg. The front frame 40 is locked into place by user weight when a user sits down on so that the front frame does not have a failure and fold on the user while the user is sitting in the chair. The front frame 40 has a front frame right lower support 41 and a front frame left lower support 42. The front frame right lower support 41 is pivotally connected to the front frame lower right connection 47. The front frame lower right connection 47 is disposed to slide up and down along a vertical support of a leg. The front frame left lower support 42 is pivotally connected to the front frame lower left connection 48. The front frame lower left connection 48 is also mounted to slide up and down along a vertical support of a leg. The front frame right upper support 23 has connection to an upper horizontal support at a front frame right upper connection 45. The front frame left over support 44 as connection to an upper horizontal support at a front frame left upper connection 46. The front frame right upper support 43 is pivotally connected to the front frame right lower support 41 at a front frame right pivoting connection 143. The front frame left upper support is pivotally connected to the front frame left lower support 42 at a front frame left pivoting connection 144. The front frame upper hinge 49 makes hinge connection between the front frame right lower support 41 and the front frame left lower support 42. The front frame lower hinge 149 makes hinge connection between the front frame right upper support 43 and the front frame left upper support 44.

The structure of the rear frame can be a copy or a mirror image of the structure of the front frame. The rear frame 50 makes connection between the left leg and the right leg. The rear frame 50 is locked into place by user weight when a user sits down on so that the rear frame does not have a failure and fold on the user while the user is sitting in the chair. The rear frame 50 has a rear frame right lower support 51 and a rear frame left lower support 52. The rear frame right lower support 51 is pivotally connected to the rear frame lower right connection 57. The rear frame lower right connection 57 is disposed to slide up and down along a vertical support of a leg. The rear frame left lower support 52 is pivotally connected to the rear frame lower left connection 58. The rear frame lower left connection 58 is also mounted to slide up and down along a vertical support of a leg. The rear frame right upper support 53 has connection to an upper horizontal support at a rear frame right upper connection 55. The rear frame left over support 54 as connection to an upper horizontal support at a rear frame left upper connection 56. The rear frame right upper support 53 is pivotally connected to the rear frame right lower support 51 at a rear frame right pivoting connection 153. The rear frame left upper support is pivotally connected to the rear frame left lower support 52 at a rear frame left pivoting connection 154. The rear frame upper hinge 59 makes hinge connection between the rear frame right lower support 51 and the rear frame left lower support 52. The rear frame lower hinge 159 makes hinge connection between the rear frame right upper support 53 and the rear frame left upper support 54.

The term 'frame' used in this specification is used loosely and encompasses a movable bar structure is a frame because it does not move when static even though it may have pivoting connections and is movable as a mechanism during folding from an open position to a closed position through an intermediate position.

The seat back 60 has a rear seat back support 61 and a front seat back support 62 that can be riveted together at a vertical portion and then bent diverging so that the front seat back support and bends horizontally to form an armrest 63 which then bends downwardly to form a seatback front vertical member 64. A armrest support 70 preferably includes a pair of armrest support right vertical members 71 and a pair of armrest support left vertical members 75. The pair of armrest support right vertical members 71 have right grip pivots 72 mounted to them, and the pair of armrest support left vertical members 75 have left grip pivots 74 mounted to them. The pair of armrest support right vertical members 71 are pivotally or rigidly connected to the right sliding connectors, and the pair of armrest support left vertical members 75 are pivotally or rigidly connected to the left sliding connectors so that the armrest support vertical members slide up and down with the sliding connectors when the folding seat is being unfolded or folded. As the armrest support vertical members slide down, they fold down the pair of armrests since the armrest support vertical members are pivotally attached at the grip pivots to the rear seat back support members 61.

Figure 4:
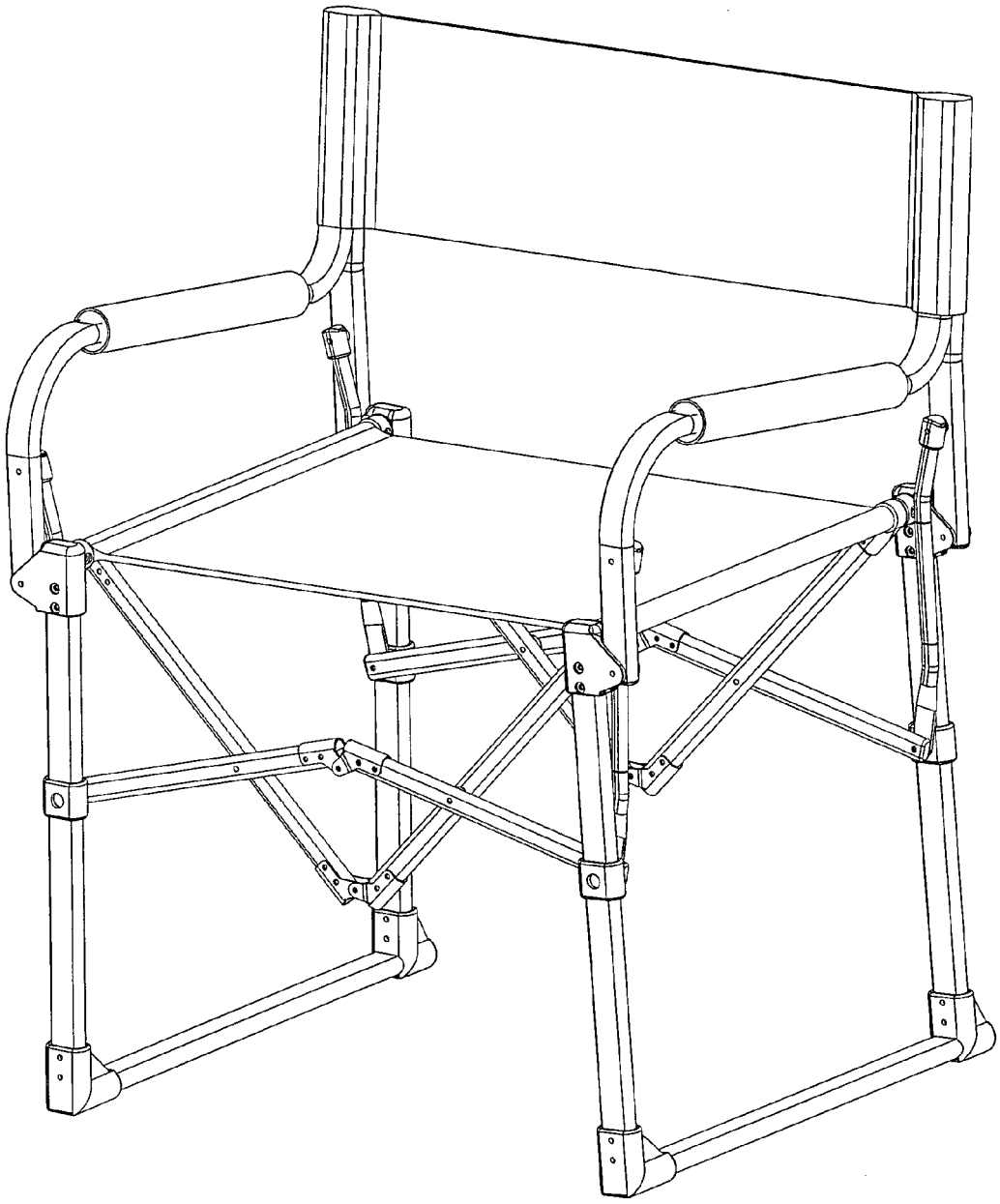
FIG. 4 is a folding chair in an open position with fabric mounted.

The folding chair frame is completed by adding a fabric cover over the folding chair frame as seen in FIG. 4. A wide variety of different fabric configurations can be attached to the arm rests, seatback and pair of right grip pivots and pair of left grip pivots. The fabric may have to be removed in certain locations for transforming the chair between closed and open position. The fabric can be connected to the folding chair frame at sleeves to receive the members and having hook and loop closure for securing the sleeves to the members. The fabric may be formed as a cover that locks the movement of the chair frame when a user is sitting down in the chair. It is preferred that the dimensions of members and connections be sized so that both fabric cover and user weight lock the chair from folding while in use in both open position for sitting and closed position for stowing.

The invention claimed is:

1. A folding chair comprising:

a. a left leg;

b. a right leg;

c. a front frame connecting the left leg to the right leg, wherein the front frame folds between an open position and a closed position;

d. a rear frame connecting the left leg to the right leg, wherein the rear frame is foldable between an open position and a closed position;

e. a left armrest pivotally mounted to a top end of the left leg;

f. a right armrest pivotally mounted to a top end of the right leg; wherein the left armrest and the right armrest fold from an upward position to a downward position;

g. wherein the front frame further comprises a front frame right upper support pivotally connecting to a front frame left upper support, wherein the front frame right upper support is pivotally connected to the right leg at a front right upper connection, wherein the front frame left upper support is pivotally connected to the left leg at a front left upper connection; and wherein the front frame further comprises a front frame right lower support pivotally connecting to a front frame left lower support, wherein the front frame right lower support is pivotally connected to the right leg at a front right lower connection, wherein the front frame left lower support is pivotally connected to the left leg at a front left lower connection;

h. wherein the front frame right lower support pivotally connects to the front frame right upper support at a front frame right pivoting connection; and wherein the front frame left lower support is pivotally connecting to the front frame left upper support at a front frame left pivoting connection, wherein the front frame right lower support is pivotally mounted to a front frame right lower connection;

i. a right leg vertical support, wherein the front frame right lower connection is slidingly mounted to the right leg vertical support, wherein the motion of the right armrest is connected via the right leg vertical support to the front frame and also to the rear frame so that deploying the front frame and the rear frame to open position automatically raises the right armrest; and j. a left leg vertical support, wherein the front frame left lower support is pivotally mounted to a front frame left lower connection, wherein the front frame left lower connection is slidingly mounted to the left leg vertical support, wherein the motion of the left armrest is connected via the left leg vertical support to the front frame and also to the rear frame so that deploying the front frame and the rear frame to open position automatically raises the left armrest.

2. The folding chair of claim 1, wherein the rear frame further comprises a rear frame right upper support pivotally connecting to a rear frame left upper support, wherein the rear frame right upper support is pivotally connected to the right leg at a rear right upper connection, wherein the rear frame left upper support is pivotally connected to the rear left leg at a rear left upper connection; and wherein the rear frame further comprises a rear frame right lower support pivotally connecting to a rear frame left lower support, wherein the rear frame right lower support is pivotally connected to the right leg at a rear right lower connection, wherein the rear frame left lower support is pivotally connected to the left leg at a rear left lower connection.

3. The folding chair of claim 2, wherein the rear frame right lower support is pivotally connecting to the rear frame right upper support at a rear frame right pivoting connection; and wherein the rear frame left lower support is pivotally connecting to the rear frame left upper support at a rear frame left pivoting connection; and wherein the front frame right lower support is pivotally mounted to a front frame right lower connection, wherein the front frame right lower connection is sliding mounted to a right leg vertical support; and wherein the front frame left lower support is pivotally mounted to a front frame left lower connection, wherein the front frame left lower connection is sliding mounted to a left leg vertical support.

4. The folding chair of claim 3, wherein the front frame right lower support is pivotally connecting to the front frame right upper support at a front frame right pivoting connection; and wherein the front frame left lower support is pivotally connecting to the front frame left upper support at a front frame left pivoting connection, wherein the front frame right lower support is pivotally mounted to a front frame right lower connection, wherein the front frame right lower connection is sliding mounted to a right leg vertical support; and wherein the front frame left lower support is pivotally mounted to a front frame left lower connection, wherein the front frame left lower connection is sliding mounted to a left leg vertical support.

5. The folding chair of claim 1, wherein the front frame right lower support is pivotally connecting to the front frame right upper support at a front frame right pivoting connection; and wherein the front frame left lower support is pivotally connecting to the front frame left upper support at a front frame left pivoting connection, wherein the front frame right lower support is pivotally mounted to a front frame right lower connection, wherein the front frame right lower connection is sliding mounted to a right leg vertical support; and wherein the front frame left lower support is pivotally mounted to a front frame left lower connection, wherein the front frame left lower connection is sliding mounted to a left leg vertical support.

6. The folding chair of claim 1, wherein the rear frame right lower support is pivotally connecting to the rear frame right upper support at a rear frame right pivoting connection; and wherein the rear frame left lower support is pivotally connecting to the rear frame left upper support at a rear frame left pivoting connection; and wherein the front frame right lower support is pivotally mounted to a front frame right lower connection, wherein the front frame right lower connection is sliding mounted to a right leg vertical support; and wherein the front frame left lower support is pivotally mounted to a front frame left lower connection, wherein the front frame left lower connection is sliding mounted to a left leg vertical support.

* * * * *